US012693091B2

(12) United States Patent
Fleming et al.

(10) Patent No.: US 12,693,091 B2
(45) Date of Patent: Jul. 28, 2026

(54) DROP-IN SIMULATOR FOR LOWER RECEIVER AND METHODS OF MAKING THE SAME

(71) Applicant: INVERIS TRAINING SOLUTIONS, INC., Suwanee, GA (US)

(72) Inventors: Paul Heath Fleming, Sugar Hill, GA (US); James M. Napier, Buford, GA (US); Darren Shavers, Atlanta, GA (US)

(73) Assignee: Inveris Training Solutions, Inc., Suwanee, GA (US)

( * ) Notice: Subject to any disclaimer, the term of this patent is extended or adjusted under 35 U.S.C. 154(b) by 1159 days.

(21) Appl. No.: 17/559,601

(22) Filed: Dec. 22, 2021

(65) Prior Publication Data

US 2022/0276018 A1 Sep. 1, 2022

Related U.S. Application Data

(60) Provisional application No. 63/129,333, filed on Dec. 22, 2020.

(51) Int. Cl.
*F41A 33/06* (2006.01)

(52) U.S. Cl.
CPC ..... *F41A 33/06* (2013.01)

(58) Field of Classification Search
CPC ..... F41A 33/06; F41A 33/04; F41A 19/10; F41A 19/02; F41A 33/00; F41B 11/56; F41B 11/62; F41B 11/724; G05D 16/0402; G05D 16/103; Y10T 137/7795; Y10T 137/7801; Y10T 137/87917; F42B 6/10

See application file for complete search history.

(56) References Cited

U.S. PATENT DOCUMENTS

| | | | | |
|---|---|---|---|---|
| 4,770,153 | A * | 9/1988 | Edelman | F41B 11/724 137/505.22 |
| 6,543,475 | B2 * | 4/2003 | Colby | G05D 16/103 137/505.25 |
| 10,598,459 | B2 | 3/2020 | Jakob | |
| 2005/0074726 | A1 * | 4/2005 | Metcalfe | F41B 11/724 434/18 |
| 2007/0017524 | A1 | 1/2007 | Wilson, Jr. et al. | |
| 2019/0049211 | A1 | 2/2019 | Nachefski | |

FOREIGN PATENT DOCUMENTS

| | | | |
|---|---|---|---|
| DE | 102015211619 | A1 | 12/2016 |
| EP | 3109584 | A1 | 12/2016 |
| WO | 2015006208 | A1 | 1/2015 |

* cited by examiner

*Primary Examiner* — Kang Hu
*Assistant Examiner* — Anthony James Bulthuis
(74) *Attorney, Agent, or Firm* — Orbit IP, LLP

(57) ABSTRACT

Weapon simulators and components for a weapon simulator are provided. In particular, a lower receiver for a weapon simulator is provided. In preferred embodiments, the lower receiver comprises a first air pressure regulator contained within the lower receiver and a second air pressure regulator contained within the lower receiver and designed to supply a higher pressure compressed air than the first air pressure regulator. The first output of the first air pressure regulator controls the second output of the second air pressure regulator. The lower receiver is designed to have the higher pressure compressed air from the second air pressure regulator drive a simulation component.

6 Claims, 6 Drawing Sheets

DROP-IN SIMULATOR FOR LOWER RECEIVER AND METHODS OF MAKING THE SAME

CROSS-REFERENCE TO RELATED APPLICATION

This application claims the benefit of U.S. Provisional Application No. 63/129,333, filed on Dec. 22, 2020, which is hereby incorporated by reference in its entirety and is considered a part of this specification.

FIELD

This patent document relates to weapon simulators and methods of making the same. In particular, this patent document relates to a drop in solution that may turn a real live fire weapon into a weapon simulator.

BACKGROUND

Applicant has produced high fidelity weapon simulators for years with high form, fit and function (FFF). These simulators are dedicated simulators, often starting as government furnished live weapons that are then modified to add simulator components for actuating the recoil pneumatically, as well as adding sensors used for diagnostics and electronically controlling the recoil behavior. Often, end users do not have the budgets to pay for dedicated weapon simulators and would benefit from kits that could be added to live weapons to turn them into weapon simulators temporarily. This would also allow them to be switched back easily into live weapons. To this end, there is a need in the market for a drop in solution that can convert a live weapon into a weapon simulator.

SUMMARY OF THE EMBODIMENTS

Objects of the present patent document are to provide a drop in solution in the form of a module or modules that would convert a live weapon into a weapon simulator. The weapon simulator need only simulate at least one function of a live weapon but the more functions it simulates the better. As just a few examples, the simulator can imitate, recoil, shell ejection, sound, smell, weight, firing, or any other number of characteristics. To this end, various embodiments of weapon simulator modules are provided.

In preferred embodiments, a lower receiver for a weapon simulator is provide. The lower receiver comprises a first air pressure regulator contained within the lower receiver and a second air pressure regulator contained within the lower receiver and designed to supply a higher pressure compressed air than the first air pressure regulator. The output of the first air pressure regulator controls the output of the second air pressure regulator. The lower receiver is designed to have the higher pressure compressed air from the second air pressure regulator drive a simulation component. A simulation component can be a bolt assembly, recoil simulator, shell ejection, sound generator, smell generator, weight simulator, firing simulator, or any other number of simulation devices.

In preferred embodiments, the lower receiver is design to replace the lower receiver of a real firearm. In even more preferred embodiments, the lower receiver is designed to replace the lower receiver of a real firearm without modification to the real firearm.

In preferred embodiments, the output of the first air pressure regulator is between 50 psi and 175 psi. In some preferred embodiments, the output of the second air pressure regulator is between 600 psi and 1200 psi. In some embodiments, the output of the first air pressure regulator is about 150 psi or 150±50 psi. In some embodiments, the output of the second air pressure regulator is about 900 psi or 900±100 psi.

DETAILED DESCRIPTION OF THE DRAWINGS

Figure 1:
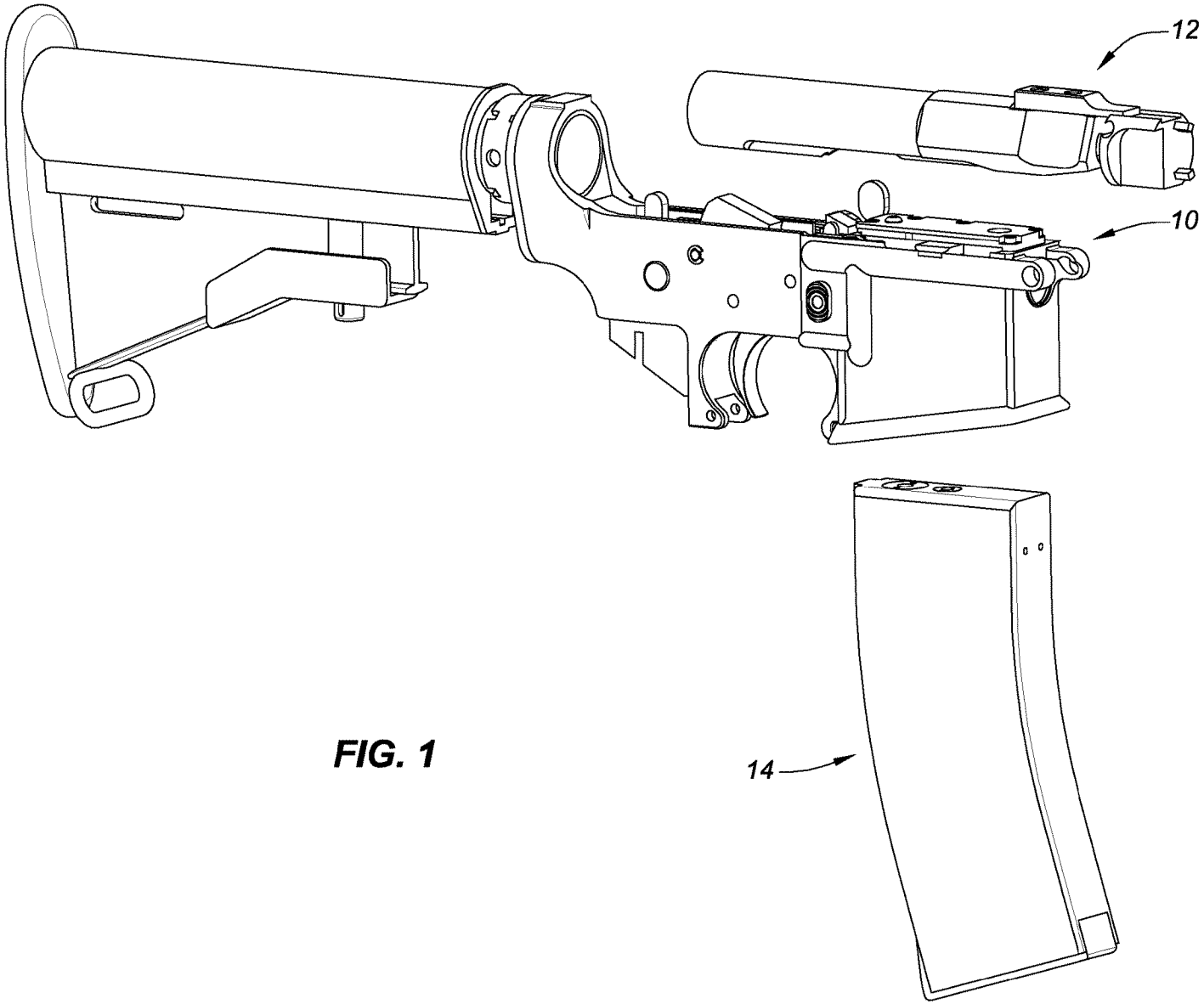
FIG. 1 illustrates an isometric exploded view of the rear components of a weapon with simulator components installed.

The present patent document describes embodiments of a drop-in solution to convert a live weapon into a weapon simulator. In the embodiments described herein, the solution drops into the lower receiver. FIG. 1 illustrates an isometric exploded view of the rear components of a weapon with simulator components installed. The components of the weapon shown in FIG. 1 include the bolt assembly 12, the lower receiver 10 and the magazine 14. In preferred embodiments, the system replaces one or more of the live weapon lower receiver 10, fire control group, bolt assembly 12 or magazine 14. In preferred embodiments, the system replaces all three of the lower receiver 10, bolt assembly 12 and magazine 14 with a simulator component.

The weapon shown in FIG. 1 is an M4 rifle but the modules and techniques taught herein may be adapted to any weapon either military or commercial. In addition, the systems and methods taught here can be used with assault rifles, hand guns, or other firearms.

Figure 2:
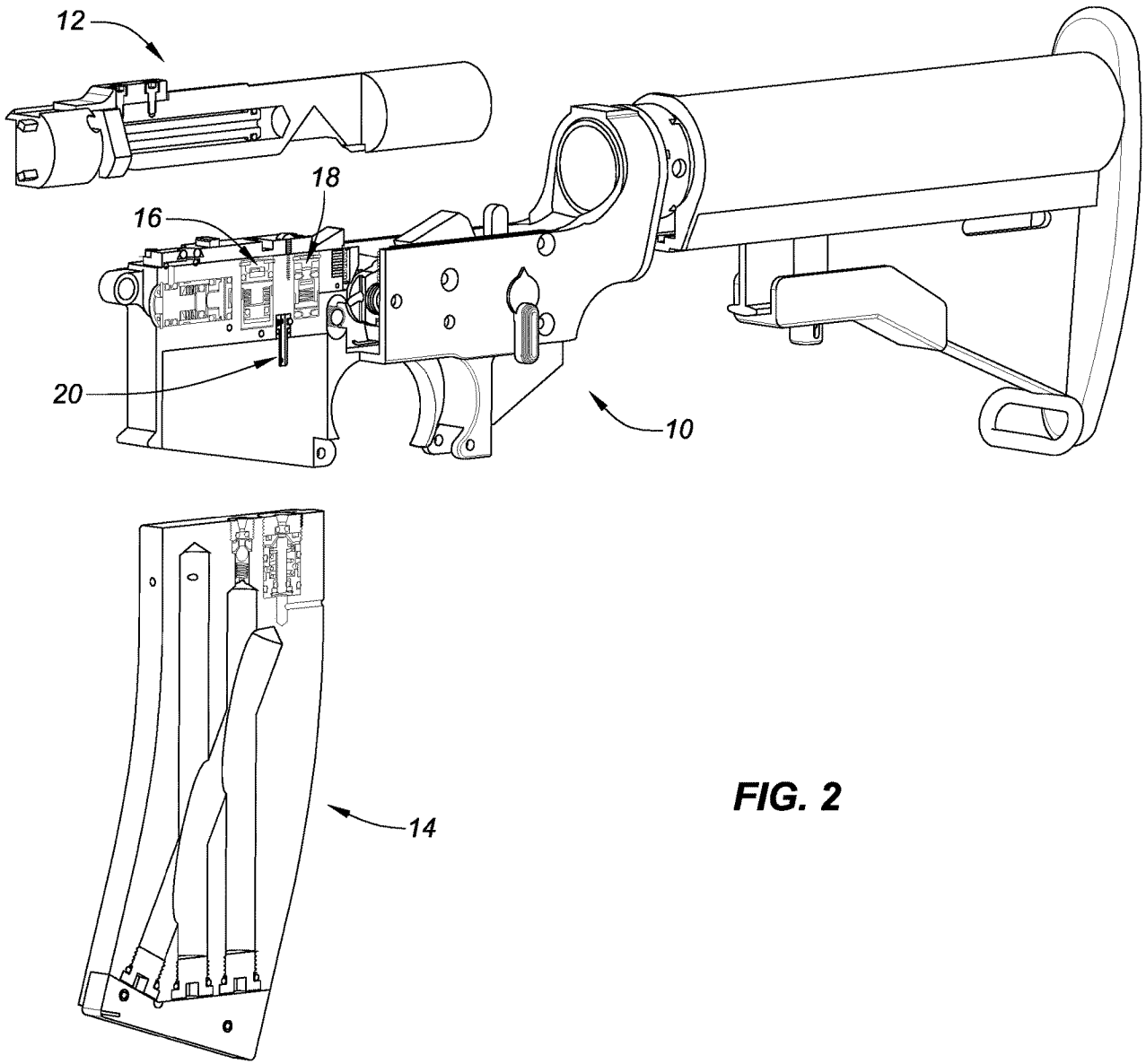
FIG. 2 illustrates an exploded view of the rear half of a live weapon with transparent parts to show the instillation of the simulator components.

In preferred embodiments, the weapon simulator system contains a compressed air regulation system comprised of dual pressure outputs from a single high-pressure input in a self-contained lower receiver or fire control group 10. FIG. 2 illustrates an exploded view of the rear half of the drop in kit with transparent parts to show the instillation of the simulator components. As may be seen in FIG. 2, the lower receiver 10 has a high-pressure regulator 16 and a low-pressure regulator 18. The compressed air input 20 is located on the bottom of the simulator component in the lower receiver such that it can interface with the components installed in the magazine 14.

The simulator components installed in the lower receiver 10 provide dual pressure outputs, a low-pressure output and a high-pressure output. Compressed air is stored in simulator components located in the magazine 14. The compressed air may be held at any pressure but in some embodiments may be as high as 3500 psi. In preferred embodiments, the pressure is stored in one or more containers in the magazine 14 around 3000 psi. The low-pressure regulator 18 takes the stored compressed air from the magazine 14 and provides a regulated low-pressure output. For the purposes of this system, "low pressure" means 150 psi±50 psi. In other embodiments, other pressures can be used for the low-pressure output including any pressure between 50 and 175. However, preferably the low pressure is around 150 psi.

The high-pressure regulator 16 takes the stored compressed air from the magazine 14 and provides a regulated high-pressure output. For the purposes of this system, "high-pressure" means 900 psi±100 psi. In other embodiments, other pressures can be used for the high-pressure output including any pressure between 600 and 1200 psi. However, preferably the high-pressure is around 900 psi.

Figure 3:
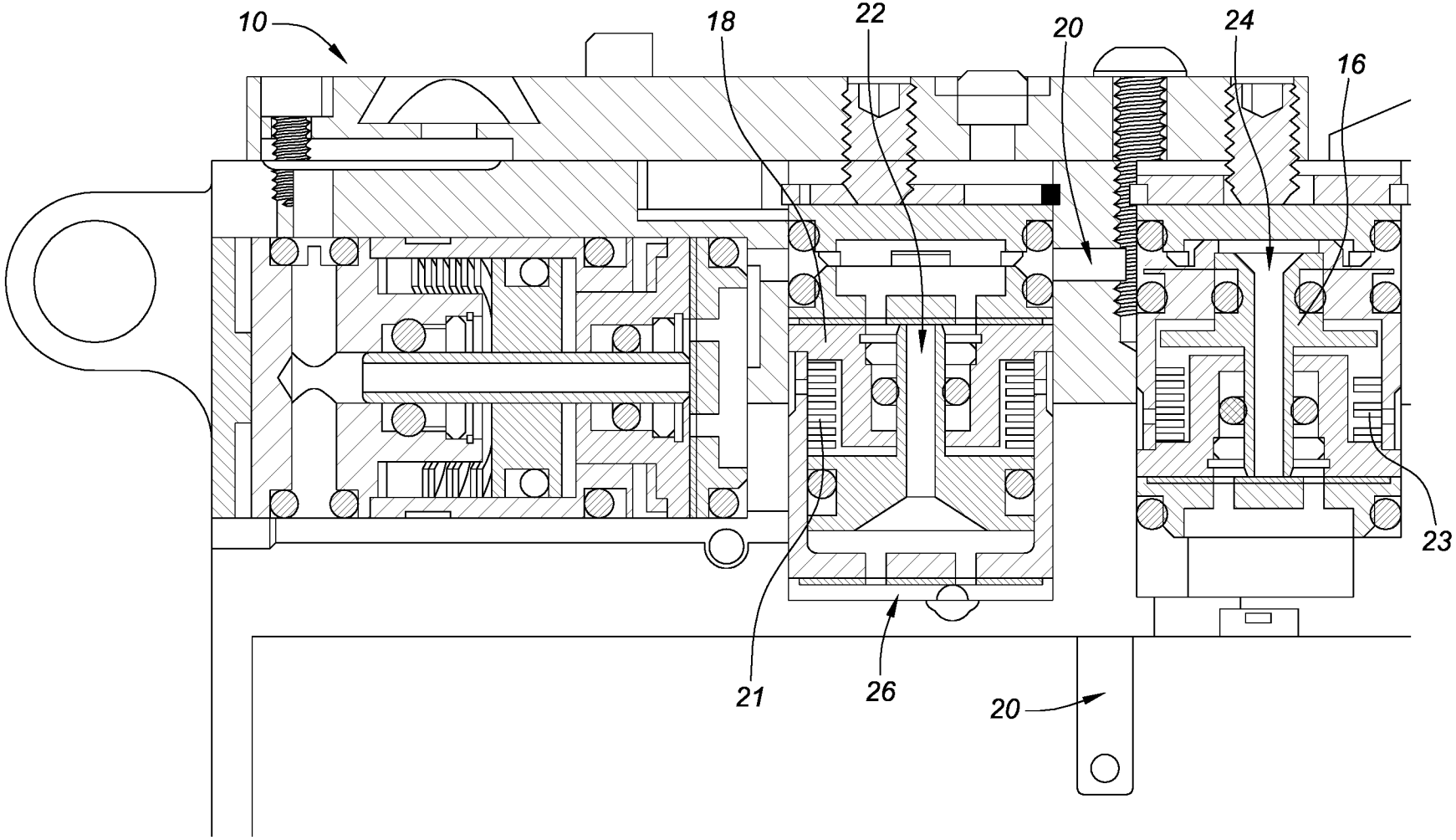
FIG. 3 illustrates a close-up cross-sectional view of some of the components of the simulator system within the lower receiver.

FIG. 3 illustrates a close-up cross-sectional view of some of the components of the simulator system within the lower receiver 10. As discussed above, the two main components installed in the lower receiver that create the dual pressure system for the weapon simulator are a high-pressure regulator 16 and a low-pressure regulator 18. In preferred embodiments, both of the high-pressure regulator 16 and low-pressure regulator 18 consist of dual valve pistons 22 and 24 in a common apparatus housing. The common apparatus housing in this example is the drop in lower receiver. Both pressure regulators are installed in the drop in lower receiver. Each valve piston is held open by a biasing spring and is closed as regulated pressure produces enough force to oppose the spring. Within each regulator, each valve piston 22 and 24 is held in the open position by a spring 21 and 23 on one side. Regulated pressure acts on the opposing side to close the valve. The sizing of each of the dual regulators is such that valve closing occurs when the desired regulated pressure is achieved.

Traditional weapon simulators using compressed gas use only low pressure unregulated compressed gas or unregulated high-pressure gases such as carbon dioxide ("CO2"). This apparatus provides regulated compressed air delivery in dual outputs, low pressure and high-pressure. It is unique to have dual regulated pressure outputs self-contained in an apparatus that replaces a live weapon receiver or fire control group. The dual regulators provide high-pressure for recoil force and a lower pressure for controlling the high-pressure valve using more standard and readily available solenoid operated valves designed for the lower pressure. The low pressure allows electronic control of a high-pressure valve via a solenoid operated valve.

Figure 4:
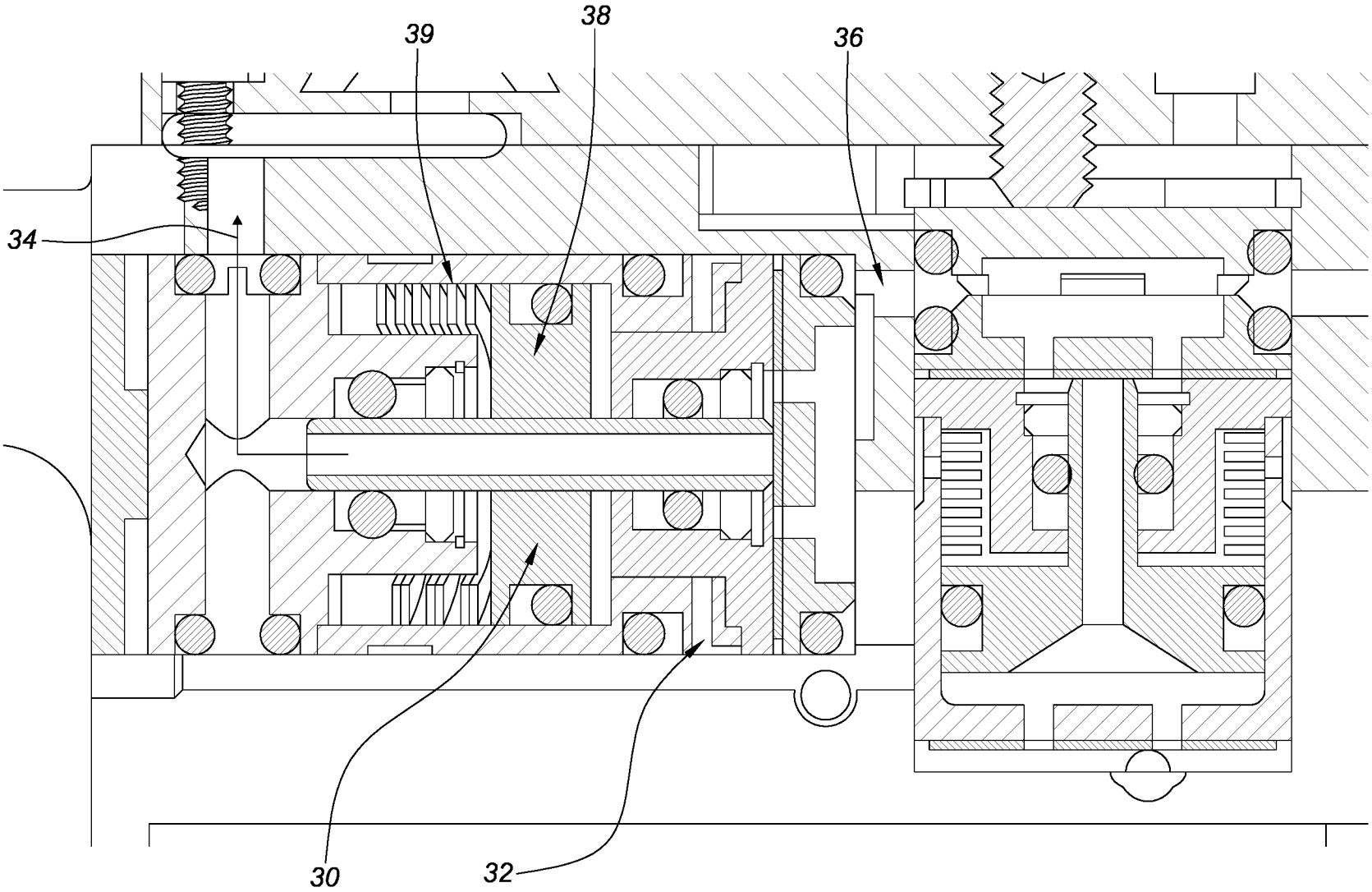
FIG. 4 illustrates a closer cross-sectional view of FIG. 3.

FIG. 4 illustrates a closer cross-sectional view of FIG. 3. The simulator system in the lower receiver 10 contains a solenoid operated valve (hidden) whose output 32 controls a high-pressure, pilot operated valve 30. This high-pressure valve 30 supplies compressed air for simulated recoil via an output 34 on the top side of the high-pressure valve 30, which drives a simulated bolt assembly. The solenoid valve 30 is supplied by regulated low pressure compressed air from the dual pressure regulation system. The solenoid valve 30 is controlled by an electrical signal and selectively supplies 150 psi regulated compressed air pressure to the control side of the high-pressure recoil valve.

The high-pressure recoil valve 30 opens when actuated by the 150 psi compressed air from the solenoid valve. Once opened, the valve allows the flow of 900 psi regulated compressed air from the high-pressure input 36 into a simulated bolt assembly which creates simulated recoil.

The high-pressure valve components consist of a valve piston 38 and spring assembly 39. The valve piston 38 is held in the closed position by the spring 39. The valve 30 is actuated into the open position when gas pressure from the solenoid valve is supplied to the opposing side of the valve piston 38.

Traditional weapon simulators using high-pressure compressed gas will control the flow of gas mechanically, utilizing the trigger pull or hammer to actuate a mechanical valve. This apparatus allows the electronic control of the high-pressure recoil gas. It is unique to have simulated recoil driven by gas at such a high-pressure and be electronically controlled in a self-contained apparatus that replaces a live weapon receiver or fire control group.

Figure 5:
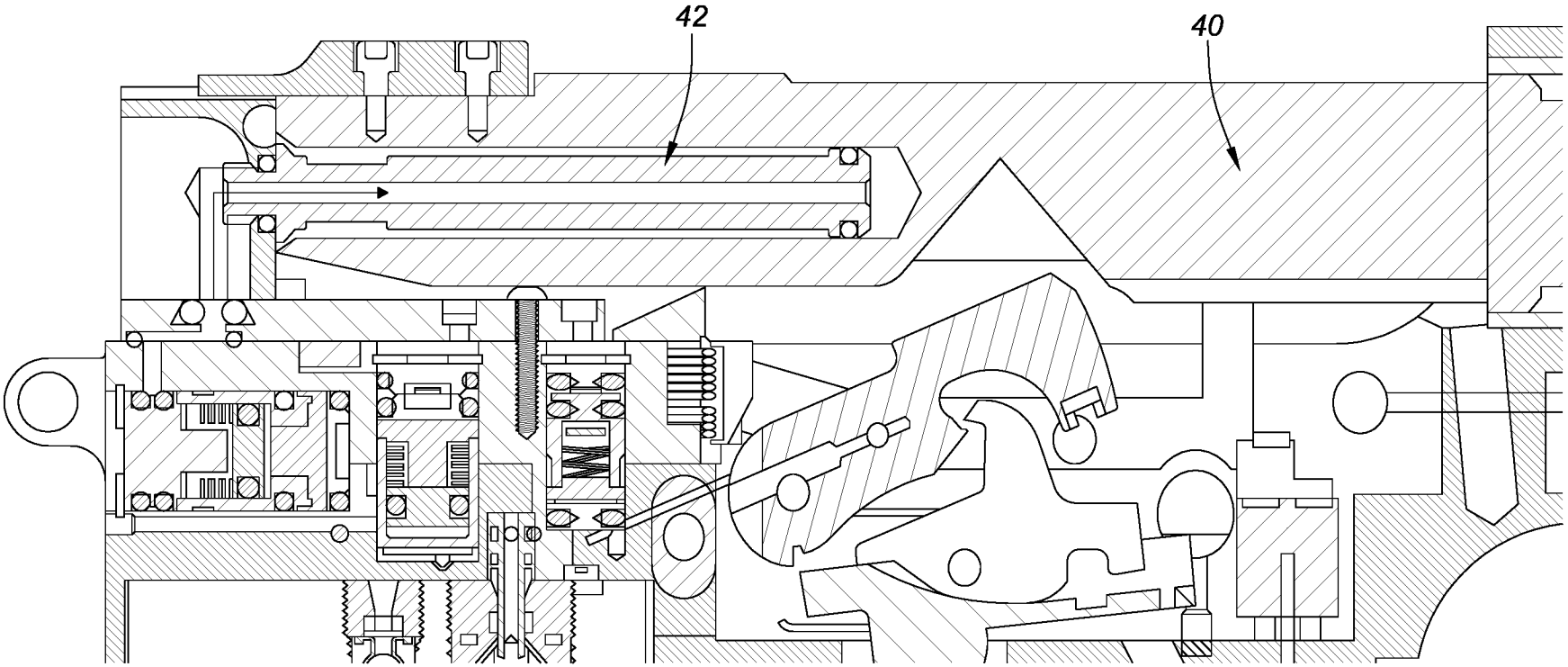
FIG. 5 illustrates a cross-sectional view of the recoil simulator connected to the lower receiver simulator.

FIG. 5 illustrates a cross-sectional view of the recoil simulator connected to the lower receiver simulator. The recoil simulator simulates the recoil of the firearm using high-pressure, regulated compressed air. The simulator system converts compressed air at storage pressure as high as 3500 psi and regulates it down to 900 psi for supplying recoil. Storing the air at a higher pressure is advantageous because it allows more air to be stored and thus, extended use to the simulator system.

Recoil is simulated by using high-pressure, regulated compressed air to accelerate a simulated bolt assembly 40. The simulated bolt assembly 40 includes a high-pressure recoil piston 42 that is rapidly accelerated by the blast of high air pressure. Because the high-pressure compressed air is regulated, the simulated recoil forces remain consistent as the pressure in the storage magazine decreases Traditional weapon simulators which use compressed air operate at pressures much lower than 900 psi or they use unregulated carbon dioxide. This apparatus allows the use of 900 psi compressed air to provide the recoil pressure to the simulated bolt assembly. It is unique to operate simulated weapon recoil using compressed air pressures higher than 150 psi.

Figure 6:
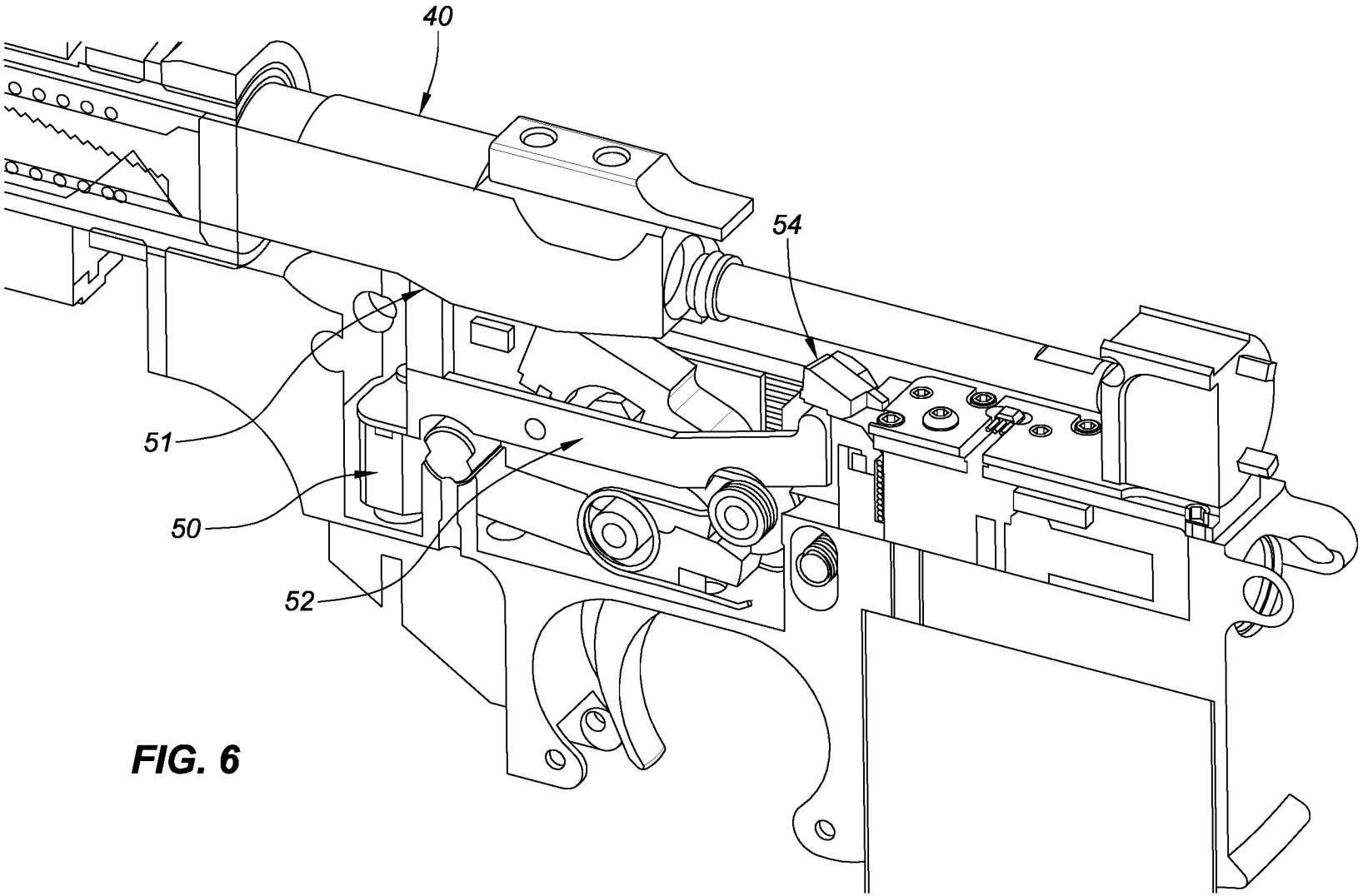
FIG. 6 illustrates an isometric view of bolt assembly and internal workings of a firearm with a simulator system installed.

FIG. 6 illustrates an isometric view of bolt assembly and internal workings of a firearm with a simulator system installed. In preferred embodiments, the simulated bolt assembly can be magnetically locked in the open position. After a pre-determined number of shots are fired, the simulated bolt assembly 40 is held in the open position using a linkage assembly 52 and an electromagnet 50. This simulates an out-of-ammunition event.

The electromagnet 50 may be in electrical communication with a controller such that it can be activated on demand by a controller. The controller may monitor the number of shots and activate the electromagnet 50 after a particular number of shot fire events. In other implementations, the electromagnet 50 may be activated manually at any time via a remote control or remote button.

During operation, the simulated bolt assembly 40 is driven rearward by the high-pressure compressed air being released by the pressure recoil valve 30. As the bolt 40 reaches the rearward position it momentarily actuates a lever linkage 52 in the lower apparatus. This momentary activation may be accomplished by any number of methods but in the embodiment shown in FIG. 6, the lever linkage 52 is momentarily activated by a lever linkage actuating ramp 51. The lever linkage 52 is rotatably coupled about a pivot point. When the bolt assembly 40 is forced rearward by the compressed air, the actuating ramp 51 slides over the portion of the lever linkage 52 aft of the pivot point and forces the aft side of the lever linkage 52 down while forcing the side of the lever linkage 52 fore of the pivot point upward on the lock-back lever 54. Using this approach allows the user to manually disengage the lock-back by pressing down on the lock-back lever 54 in the same way a user would on a live weapon.

The aft portion of the lever linkage 52 is forced downward by the bolt assembly 40 and into the proximity of an electromagnet 50. The other end of the lever linkage 52 is forced up and momentarily acts on a lock-back lever 54 that lifts it into the path of bolt assembly 40. This lock-back lever 54 is in the same location and provides the same user interface as the live weapon allowing for realistic training. When a pre-determined number of shots has been reached the electromagnet 50 is activated and holds the lever linkage 52 in position allowing the bolt 40 to catch on the lock-back lever 54.

Traditional weapon simulators either do not offer a lock back feature or the lever itself is not momentarily actuated on every shot. It is unique that the lock-back lever is momentarily actuated on every shot and may be held in position by the electro-magnet on any given shot. Because the lever is activated every shot, the simulator can produce an out of ammunition simulation on any number of shots.

The magazine has cavities machined into it that allow the storage of compressed air. The magazine also contains an interface port that prevents air from escaping until it is inserted into the drop in lower receiver. Once inserted into the drop in lower receiver a check valve within the interface port is opened allowing air to flow.

In another embodiment, the magazine 14 may house the high-pressure regulator 16. In such embodiments, the storage of compressed air may still be in the magazine 14 or may be moved to inside the lower receiver 10. Generally speaking, the low-pressure regulator 18, high pressure regulator 16 and compressed air storage can be moved between the magazine 14 and lower receiver 10 in different designs. However, as taught herein, the preferred embodiments have the compressed air in the magazine 14 and the low-pressure regulator 18 and high-pressure regulator 16 in the lower receiver 10.

In the examples provided herein, the packaging is designed such that it replaces the live weapon lower receiver. The user removes their live lower receiver and replaces it with our drop in lower receiver. This accomplishes several things. It allows the user to retain their upper receiver, sights, optics, and handguards while the drop in lower receiver simulates the trigger, fire control selector and magazine release. An additional benefit of the drop in lower receiver is that once installed the simulated weapon is no longer considered a gun per the ATF laws. This allows a user much more flexibility on how they handle and store the simulated weapon assembly.

In addition to replacing the lower receiver, the magazine may also be swapped for the magazine designed to work with the drop-in simulator in the lower receiver.

What is claimed is:

1. A lower receiver for a weapon simulator comprising:

a first air pressure regulator contained within the lower receiver and configured to convert compressed air directly from a container to a first output between 50 psi and 175 psi; and a second air pressure regulator contained within the lower receiver and configured to convert compressed air directly from the container to a second output between 600 psi and 1200 psi;

an electronically controlled solenoid valve:

wherein the electronically controlled solenoid valve controls the first output of the first air pressure regulator, which flows through the electronically controlled solenoid valve when activated and directly into a high-pressure valve which controls the second output of the second air pressure regulator; and wherein the lower receiver is designed to have the higher pressure compressed air from the second air pressure regulator drive a simulation component; and and wherein the lower receiver is designed to replace the lower receiver of a real firearm.

2. The lower receiver for a weapon simulator of claim 1, wherein the simulation component is a bolt assembly.

3. The lower receiver for a weapon simulator of claim 1, wherein the simulation component is a recoil simulator.

4. The lower receiver for a weapon simulator of claim 1, wherein the first output is about 150 psi.

5. The lower receiver for a weapon simulator of claim 4, wherein the second output is about 900 psi.

6. The lower receiver for a weapon simulator of claim 4, wherein the high-pressure valve is pilot operated valve.

* * * * *